US007624977B2

(12) United States Patent
Lee et al.

(10) Patent No.: US 7,624,977 B2
(45) Date of Patent: Dec. 1, 2009

(54) APPARATUS OF WITHDRAWING CASH FROM CASH TRANSACTION MACHINE

(75) Inventors: Won Joon Lee, Seoul (KR); Dong Sik Lee, Seoul (KR); Joong Hyuk Han, Seoul (KR); Jin Yong Hwang, Kyunggi-do (KR)

(73) Assignee: Nautilus Hyosung Inc., Seoul (KR)

( * ) Notice: Subject to any disclaimer, the term of this patent is extended or adjusted under 35 U.S.C. 154(b) by 546 days.

(21) Appl. No.: 11/242,949

(22) Filed: Oct. 5, 2005

(65) Prior Publication Data

US 2007/0001367 A1 Jan. 4, 2007

(30) Foreign Application Priority Data

Jun. 13, 2005 (KR) ..... 10-2005-0050241

(51) Int. Cl.
*B65H 5/22* (2006.01)

(52) U.S. Cl. ..... 271/3.01; 271/3.03; 271/3.14; 271/3.18

(58) Field of Classification Search ..... 271/3.01, 271/3.03, 3.14, 3.18; 209/534; 414/789.9, 414/790.7; 902/14, 15
See application file for complete search history.

(56) References Cited

U.S. PATENT DOCUMENTS 4,017,004 A * 4/1977 Onoe et al. ..... 221/94
4,320,854 A * 3/1982 Hirose ..... 221/12
4,363,584 A 12/1982 Kokubo
4,462,509 A * 7/1984 Adelberger ..... 221/259
4,616,817 A * 10/1986 Yamauchi et al. ..... 271/111
4,618,302 A * 10/1986 Kokubo et al. ..... 414/789.9
4,728,090 A * 3/1988 Oota et al. ..... 271/7

(Continued)

FOREIGN PATENT DOCUMENTS

EP 0 180 949 5/1986

(Continued)

OTHER PUBLICATIONS

European Search Report (Application No. 05256127.1) Mar. 1, 2006.

(Continued)

*Primary Examiner*—David H Bollinger
(74) *Attorney, Agent, or Firm*—Fish & Richardson P.C.

(57) ABSTRACT

A cash transaction machine includes a storage for storing paper media, a first transfer element transferring the paper media sheet by sheet from the storage, a temporary stack part located at an end portion of the first transfer element in order to stack the transferred paper media and vertically transfer a stack of the paper media, a second transfer element including an upper transfer part and a lower transfer part for transferring the stack of paper media, a rejecting element including a moving cover sliding right and left in an entry space provided at the lower transfer part, and a withdrawal extension part formed corresponding to the end portion structures of the second transfer element and the rejecting element and installed at the end portion to provide an extension path connected to the transfer path. Also, the end portion structure of the second transfer element may be identical with the end portion structure of the withdrawal extension part, thereby simply installing the withdrawal extension part at the front or the rear surfaces of the withdrawal apparatus.

13 Claims, 8 Drawing Sheets

U.S. PATENT DOCUMENTS

| | | | | |
|---|---|---|---|---|
| 5,342,165 | A | | 8/1994 | Graef et al. |
| 5,597,996 | A | * | 1/1997 | Flood ..... 235/379 |
| 5,711,649 | A | | 1/1998 | Gerlier |
| 6,315,279 | B1 | | 11/2001 | Minamishin et al. |
| 6,502,052 | B1 | | 12/2002 | Someya et al. |
| 2002/0092727 | A1 | | 7/2002 | Kato |
| 2003/0205618 | A1 | | 11/2003 | Katou et al. |
| 2004/0007624 | A1 | | 1/2004 | Ogawa et al. |
| 2004/0212141 | A1 | | 10/2004 | Graef et al. |

FOREIGN PATENT DOCUMENTS

| | | | |
|---|---|---|---|
| EP | 0 965 953 | A1 | 12/1999 |

OTHER PUBLICATIONS

Chinese Office Action from Application No. 200510116395.2 dated Jan. 23, 2009 (12 pages).

* cited by examiner

APPARATUS OF WITHDRAWING CASH FROM CASH TRANSACTION MACHINE

CROSS REFERENCE TO RELATED APPLICATION

This application claims the benefit of Korean Patent Application No. 2005-50241, filed on Jun. 13, 2005, in the Korean Intellectual Property Office, the disclosure of which is incorporated herein in its entirety by reference.

BACKGROUND OF THE INVENTION

1. Field of the Invention

The present invention relates to a cash transaction machine, and more particularly, to a withdrawal apparatus in which cash is withdrawn at the front surface or rear surface of a cash transaction machine.

2. Description of the Related Art

A cash transaction machine is an automation apparatus which can support a basic banking service such as depositing or withdrawing cash without a bank staff, regardless of place or time, with respect o financial service. The cash transaction machine may be divided into a cash dispenser and an automated teller machine according to whether cash is paid into or withdrawn and used for not only depositing or withdrawing cashes but also depositing or withdrawing checks, arranging bankbooks, and selling tickets.

Now, using the cash transaction machine is gradually increased in banks or other financial agency. Gradually, customers frequently use the cash transaction machine according that using the cash transaction machine becomes convenient. As increase of frequency of using the cash transaction machine, the amount of each banking transaction is increased together. According to the increase of the amount dealt via the cash transaction machine, a lot of notes are paid into or withdrawn. According to using the lot of notes, there are frequently generated unexpected matters due to movement or position interference between notes.

FIG. 1 is a perspective view of a conventional cash transaction machine.

Referring to FIG. 1, a cash transaction machine is an apparatus for depositing or withdrawing cashes or checks, in which several modules divided into function units, such as a magnetic card reading module, a bankbook arrangement module, a user interface module, and a note deposit/withdrawal module, are installed in a housing.

The magnetic card reading module is exposed outside via a card insertion part 10, and the user interface module is exposed outside via a display screen 20 or a key input part 25.

The note withdrawal module is exposed outside via a cash discharge part 30. The cash discharge part 30 is according to a direct discharge type, in which previously requested amount of cash is prepared in the note withdrawal module and the cash is provided as a stack from the cash discharge part 30.

In the front insertion type, the position of inserting the cassette is the same as the direction of the withdrawal part. In case that the front surface of a cash transaction machine is opened and closed, a withdrawal apparatus of the front insertion type is used.

In the rear insertion type, the position of inserting the cassette is opposite to the direction of the withdrawal part. In case that the rear surface of a cash transaction machine is opened and closed, a withdrawal apparatus of the rear insertion type is used.

Accordingly, in case that the cash cassette is changed, the front insertion type has to be used in the withdrawal apparatus of a cash transaction machine whose front surface is opened and closed and the rear insertion type has to be used in the withdrawal apparatus of a cash transaction machine whose rear surface is opened and closed.

SUMMARY OF THE INVENTION

To solve the described problems, the present invention provides a withdrawal apparatus capable of freely inserting paper media such as cash into the front surface or the rear surface of a cash transaction machine without regard of an opening and closing method of the cash transaction machine.

According to an aspect of the present invention, a withdrawal apparatus of a cash transaction machine includes a first transfer element and a second transfer element which are separated from each other, and a temporary stack part moves between the first transfer element and the second transfer element to function as a part of the second transfer element. For example, the temporary stack part may be located at an end portion of the first transfer element and receive paper media sheet by sheet from a storage. When a requested amount of the paper media is loaded, the temporary stack part moves to the second transfer element and locates a stack of the paper media on a transfer path of the second transfer element. The second transfer element may start to operate and transfer the paper media stack to a withdrawal part.

The transfer path is defined by the first transfer element and second transfer element. The first transfer element transfers the paper media from the storage to the temporary stack part, and the second transfer element transfers the paper media stack transferred by the temporary stack part to a withdrawal extension part. Generally, the first and second transfer elements move in one direction.

Also, the second transfer element includes an upper transfer part and a lower transfer part. The upper transfer part is provided above the transfer path to define its upper boundary, and includes upper rollers disposed at the both ends thereof and an upper rotation transfer belt passing through the upper rollers and rotating. The lower transfer part is provided below the transfer path to define its lower boundary. The upper transfer part is integrated in a body, while the lower transfer part may be integrated in a body or separated to form two or more bodies, such that the lower transfer part may provide an entry space for the temporary stack part. The lower transfer part includes lower rollers provided below the transfer path and at least one lower rotation transfer belt passing through the lower rollers and rotating the path except the entry space.

The lower transfer part may be longer than the upper transfer part to be projected from the both ends of the upper transfer part as the same length. Thus the second transfer element may have a symmetrical structure, and its symmetrical structure may be advantageously applied to the position change of a withdrawal extension part.

Also, converting the withdrawal apparatus into a front insertion type or a rear insertion type may be easily performed by using the first and second transfer element. Generally, a cassette is used for storing and inserting the paper media. In the front insertion type, the position of inserting the cassette is the same as the direction of the withdrawal part. In case that the front surface of a cash transaction machine is opened and closed, a withdrawal apparatus of the front insertion type is used. In the rear insertion type, the position of inserting the cassette is opposite to the direction of the withdrawal part. In case that the rear surface of a cash transaction machine is opened and closed, a withdrawal apparatus of the rear insertion type is used. In the withdrawal apparatus according to the present invention, the position of inserting the cassette is fixed, the position of the withdrawal part may changed by switching the rotation direction of the second transfer element. The change is possible because the first transfer element is separated from the second transfer element. The procedure of switching may be simply performed.

In this case, the withdrawal apparatus includes the function of withdrawal, and both of a module for only withdrawing and a module for deposit/withdrawal may be understood as the withdrawal apparatus. Also, the paper media transacted by the withdrawal apparatus is an article in a shape of a sheet, which has a certain value, such as notes, checks, gift certificates, and tickets. The paper media may be formed of a material that may be substitute for paper, such as a plastic thin film, in addition to paper.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

EMBODIMENT 1

Figure 1:
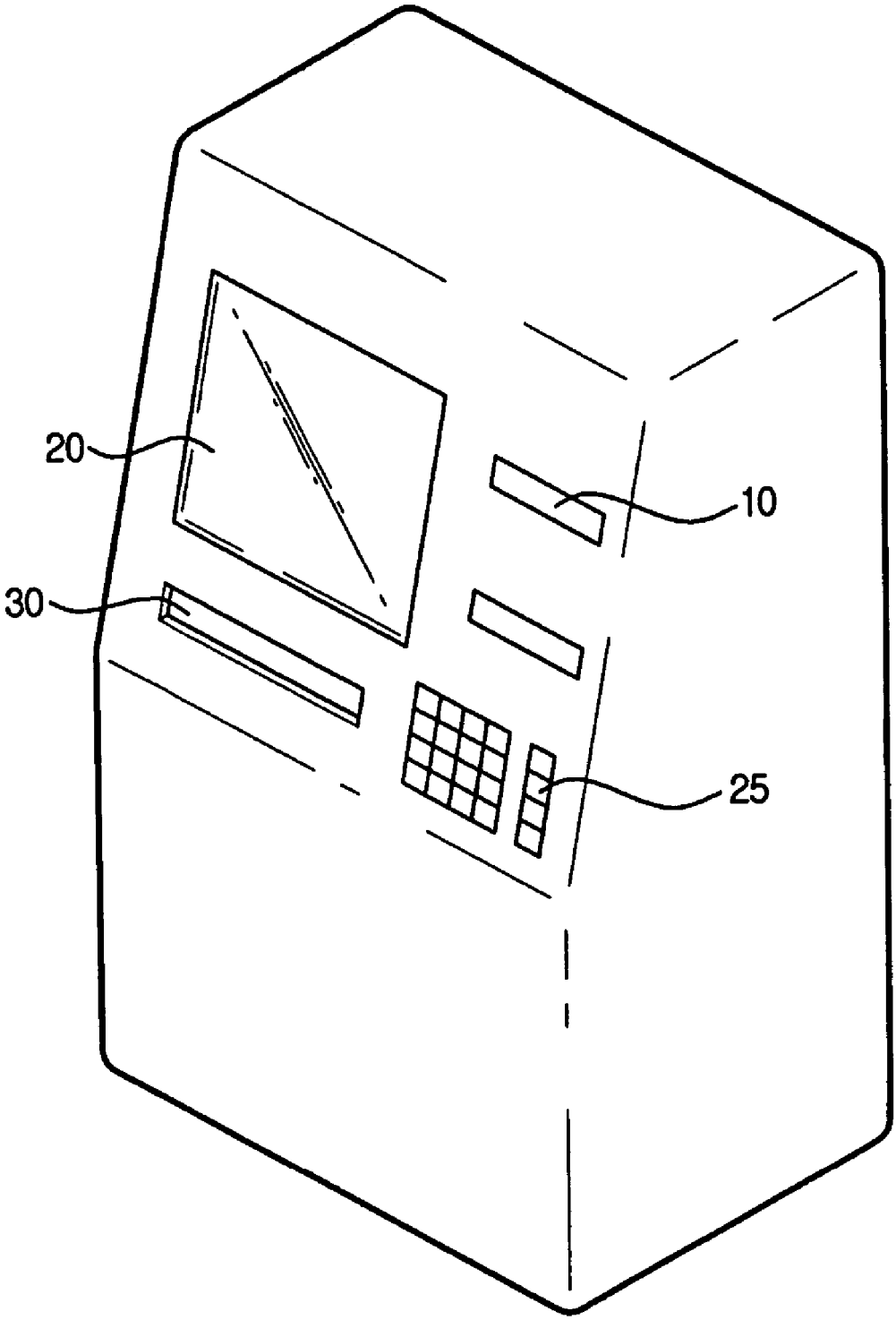
FIG. 1 (PRIOR ART)
FIG. 1 is a perspective view of a conventional cash transaction machine.
Figure 2:
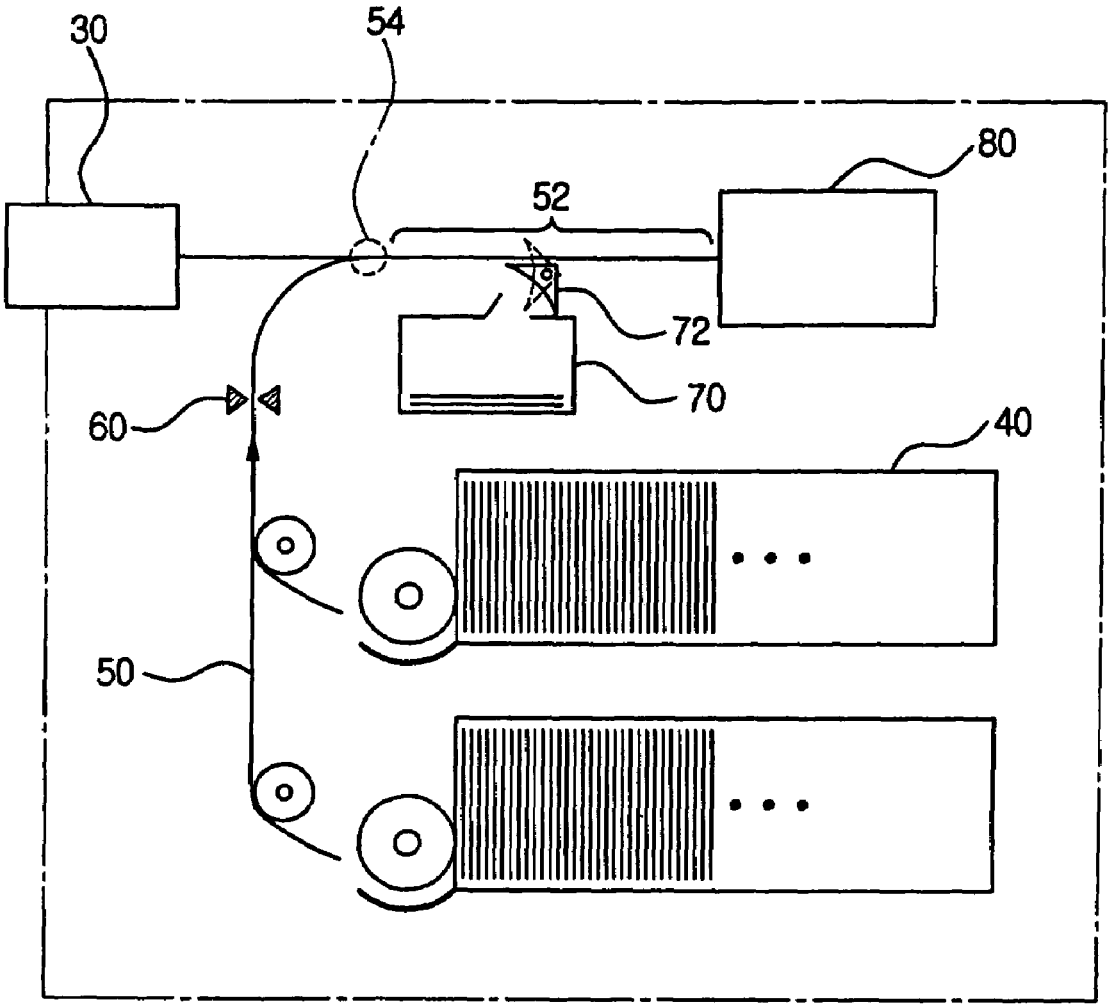
FIG. 2 (PRIOR ART)
FIG. 2 is a configuration diagram of a conventional cash transaction machine.
Figure 3:
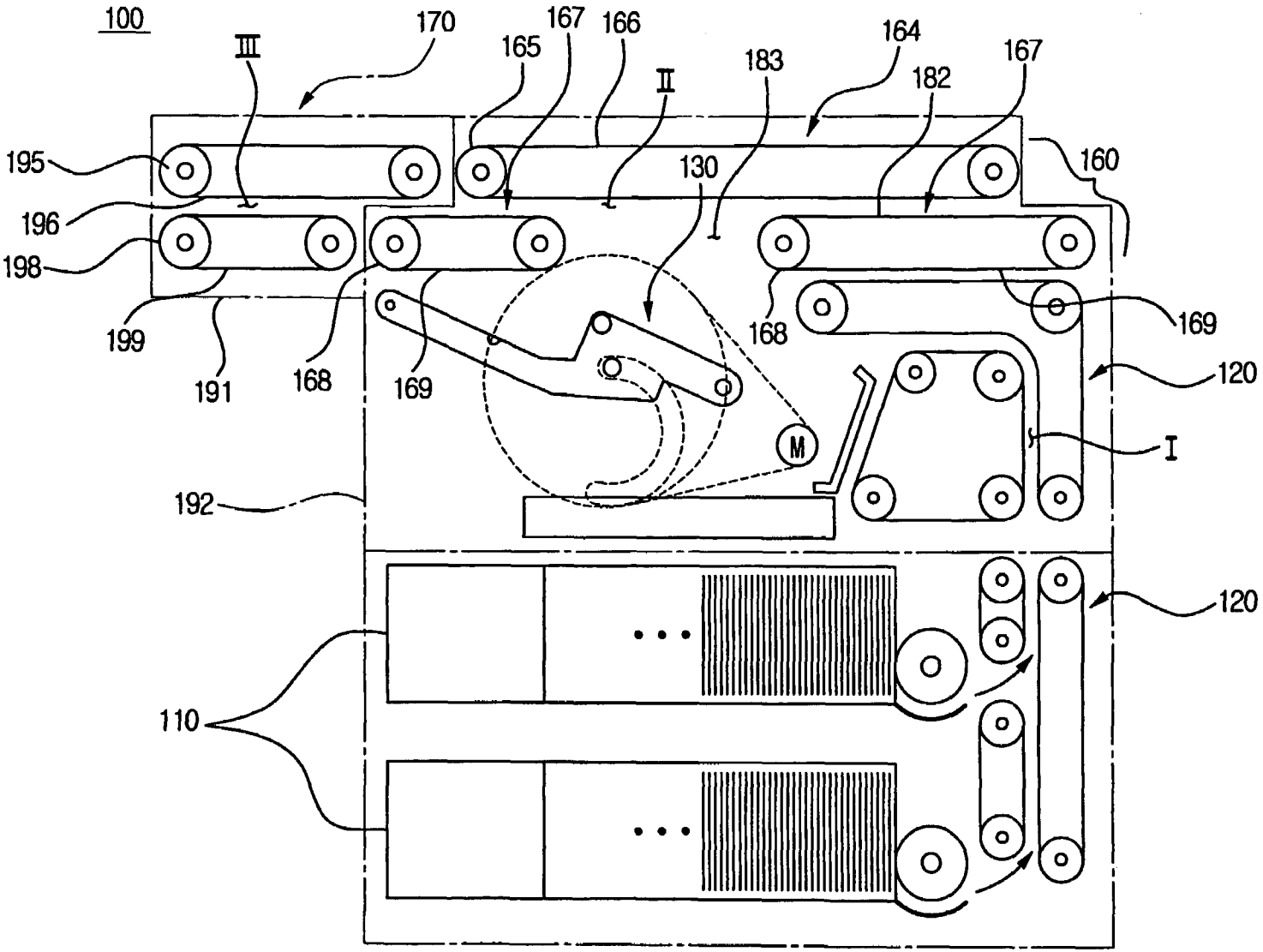
FIGS. 3 and 4 are configuration diagrams illustrating a withdrawal apparatus of a cash transaction machine according to an embodiment of the present invention.
Figure 4:
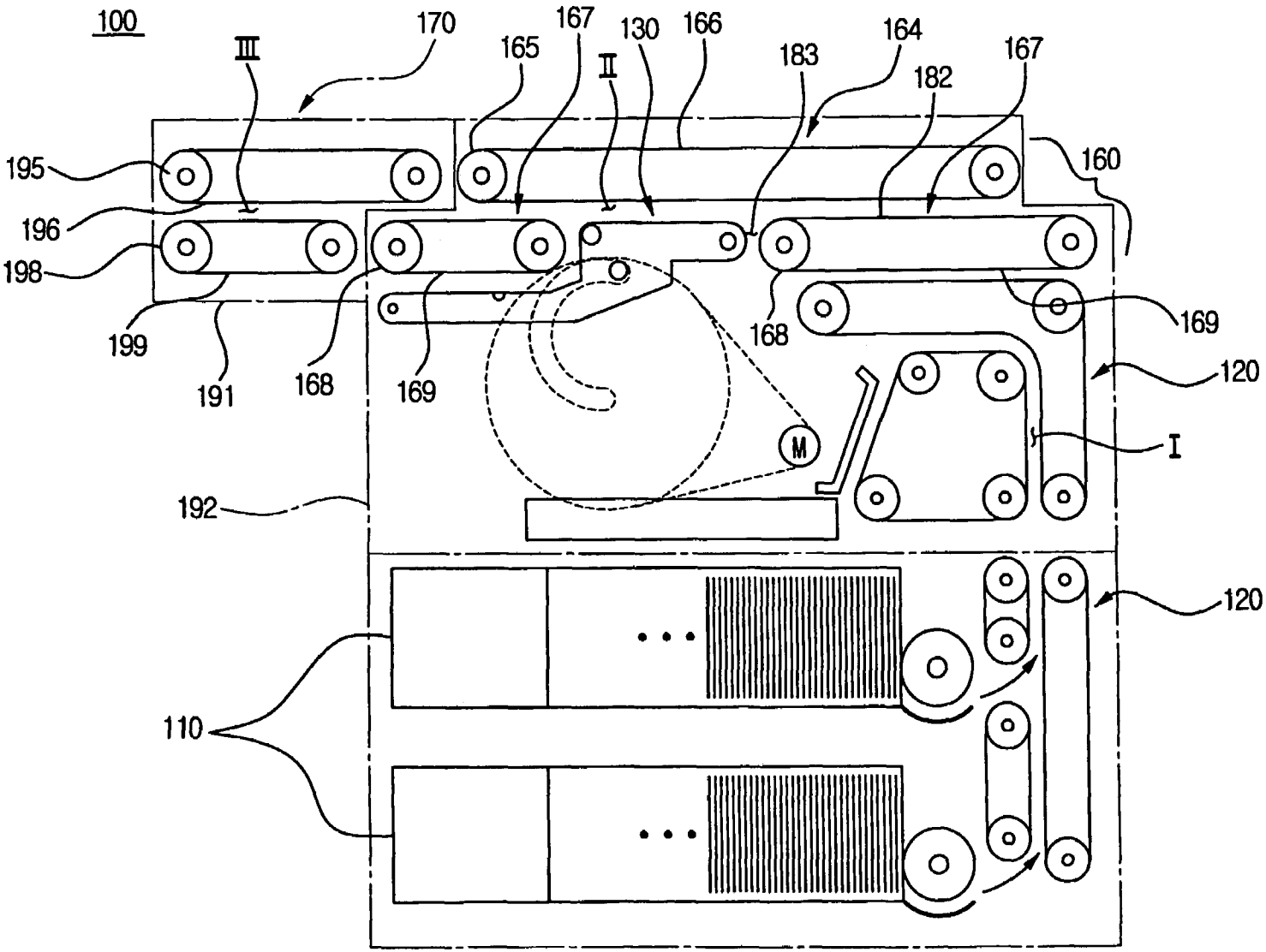

FIG. 3 is a configuration diagram illustrating a withdrawal apparatus of a cash transaction machine according to an embodiment of the present invention, and FIG. 4 is a configuration diagram illustrating operation mechanism of the withdrawal apparatus illustrated in FIG. 3.

Referring to FIG. 3, a withdrawal apparatus 100 according to the present embodiment includes a storage 110, a first transfer element 120, a temporary stack part 130, a second transfer element 160, and a withdrawal extension part 170. The withdrawal apparatus 100 includes two storages 110 for storing paper media and selects one of the two storages 110 in order to withdraw the paper media as required. The paper media withdrawn from the storage 110 sheet by sheet is transferred by the first transfer element 120 and loaded in the temporary stack part 130 sheet by sheet. In case that a predetermined amount of the paper media is loaded in the temporary stack part 130, the temporary stack part 130 moves to the second transfer element 160. A stack of the paper media may be located on a transfer path II defined by the second transfer element 160 and transferred to the withdrawal extension part 170.

The paper media transferred from the storage 110 is stacked sheet by sheet in the temporary stack part 130. In case that a predetermined amount of the paper media is loaded, the first transfer element may stop transferring the paper media and the temporary stack part 130 is transferred to the second transfer element 160.

Referring to FIG. 4, the top surface of the temporary stack part 130 may be moved to be located on the transfer path II of the second transfer element 160 and be a part of the transfer path II defined by the second transfer element 160.

After the temporary stack part 130 is transferred to the second transfer element 160, the second transfer element 160 starts to operate and transfers the paper media stack 132 in the temporary stack part 130. The paper media is transferred in the second transfer element 160 in a stack and kept being partially held by the second transfer element 160 in the withdrawal extension part 170. When the paper media stack 132 is discharged from the withdrawal extension part 170, a customer may receive a requested amount of money.

To fully describe the procedure in which the paper media stack 132 is transferred by the second transfer element 160 along the transfer path II, the second transfer element 160 includes an upper transfer part 164 and lower transfer part 167. The upper transfer part 164 includes upper rollers 165 provided at both ends above the transfer path II and an upper rotation transfer belt 166 passing through the upper rollers 16 and rotating. The lower transfer part 167 includes lower rollers 168 provided below the transfer path II except an entry space 183 for the temporary stack part 130 and at least one lower rotation transfer belt 169 passing through the lower rollers 168 and rotating the path except the entry space 183. Also, lower transfer part 167 is longer than the upper transfer part 164 to be projected from the both ends of the upper transfer part 164 as the same length to be horizontally symmetrical.

Referring to FIGS. 3 and 4 again, the withdrawal apparatus 100 includes housing plates 192 facing each other, which are shown as an one-dot chain line in figures. The housing plates 192 are departed by a predetermined distance enough to receive the first transfer element 120, the temporary stack part 130 and the second transfer element 160. First unevenness portions are formed on the both upper end portions, corresponding to the end portion structure of the second transfer element 160, and the withdrawal extension part 170 is installed in extension plates facing each other, which are departed as the same width of the housing plates 192, as shown as a one-dot chain line. Second unevenness portions are formed in an end portion of extension plates 191, respectively. Accordingly, the withdrawal extension part 170 may be selectively installed the front end portion or the rear end portion of the withdrawal apparatus 100, because the second unevenness portion formed in the end portion of the extension plates 191 are engaged with the first unevenness portion of the housing plate 192.

Also, the withdrawal extension part 170 selectively installed at the front end portion and the rear end portion of the withdrawal apparatus 100 includes first extension rollers 195 provided at both ends above an extension path III and conveying the stack of the paper media transferred by the transfer path II, first extension rotation transfer belt 196 passing through the first extension rollers 195 and rotating, second extension rollers 198 provided at both ends below the extension path III, and a second extension rotation transfer belt 199 passing through the second extension rollers 198 and rotating.

Figure 5:
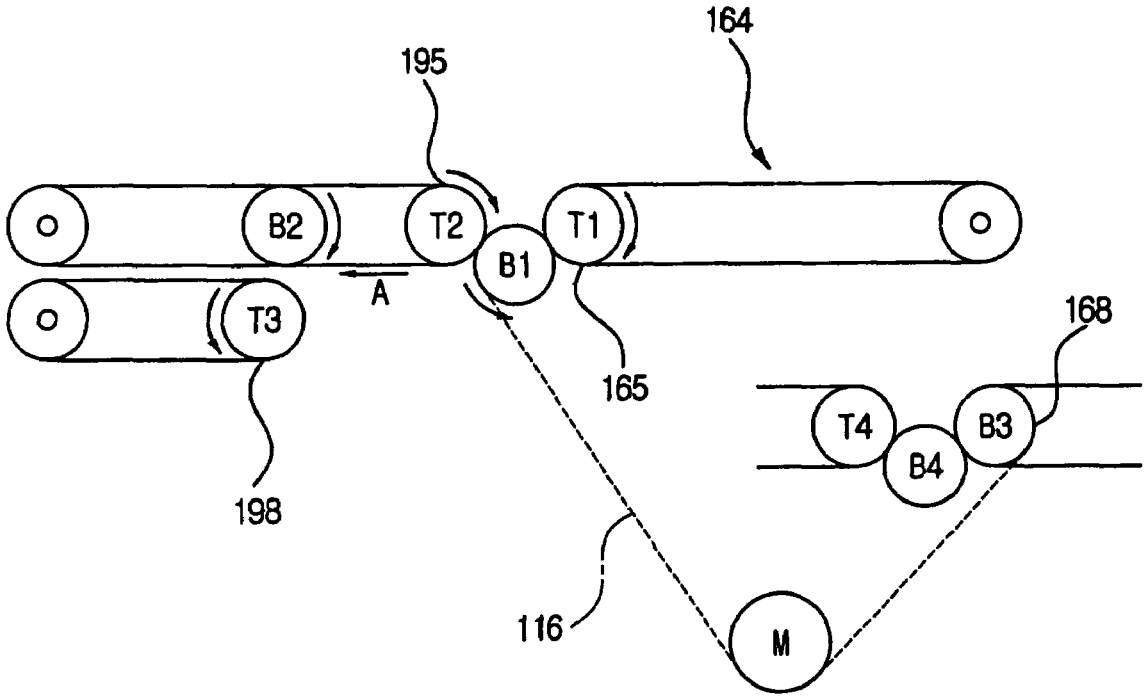
FIG. 5 is a schematic diagram illustrating power conveyance of the cash transaction machine according to the first embodiment of the present invention.

FIG. 5 is a schematic diagram illustrating a procedure of conveying power from a drive motor to the upper transfer part, lower transfer part, and the withdrawal extension part.

Referring to FIG. 5, a first branch gear B1 is installed adjacent to one of the upper rollers 165 of the upper transfer part 164 and receives rotation power of a drive motor M.

A first transmission gear T1 is installed at the pivot of the upper roller 165 and receives the rotation power from the first branch gear B1. A second transmission gear T2 is installed at the pivot of the first extension roller 195 and receives the rotation power from the first branch gear B1. Also, a third transmission gear T3 is installed at the pivot of the second roller 198 to receive the rotation power of the second transmission gear T2 and rotates in the opposite direction of the second tans gear T2 to rotate in the same direction of the first and second rotation transfer belts 196 and 199 rotating according to the first and second extension rollers 195 and 198 of the withdrawal extension part 170.

Also, a main drive belt 116 conveys the rotation of the drive motor to the first branch gear B1.

Referring to FIG. 5, the rotation power of the drive motor M is conveyed along the main drive belt 116 to a third branch gear B3, the third branch gear installed adjacent to one of the lower rollers 168 and receives the rotation power from the drive motor M, and a fourth branch gear B4 is engaged with the third branch gear B3 to receive the rotation power. Also, a fourth transmission gear T4 rotating in the opposite direction of the third branch gear B3 is installed at the pivot of the lower roller 168 to receive the rotation power from the fourth branch gear B4.

EMBODIMENT 2

Figure 6:
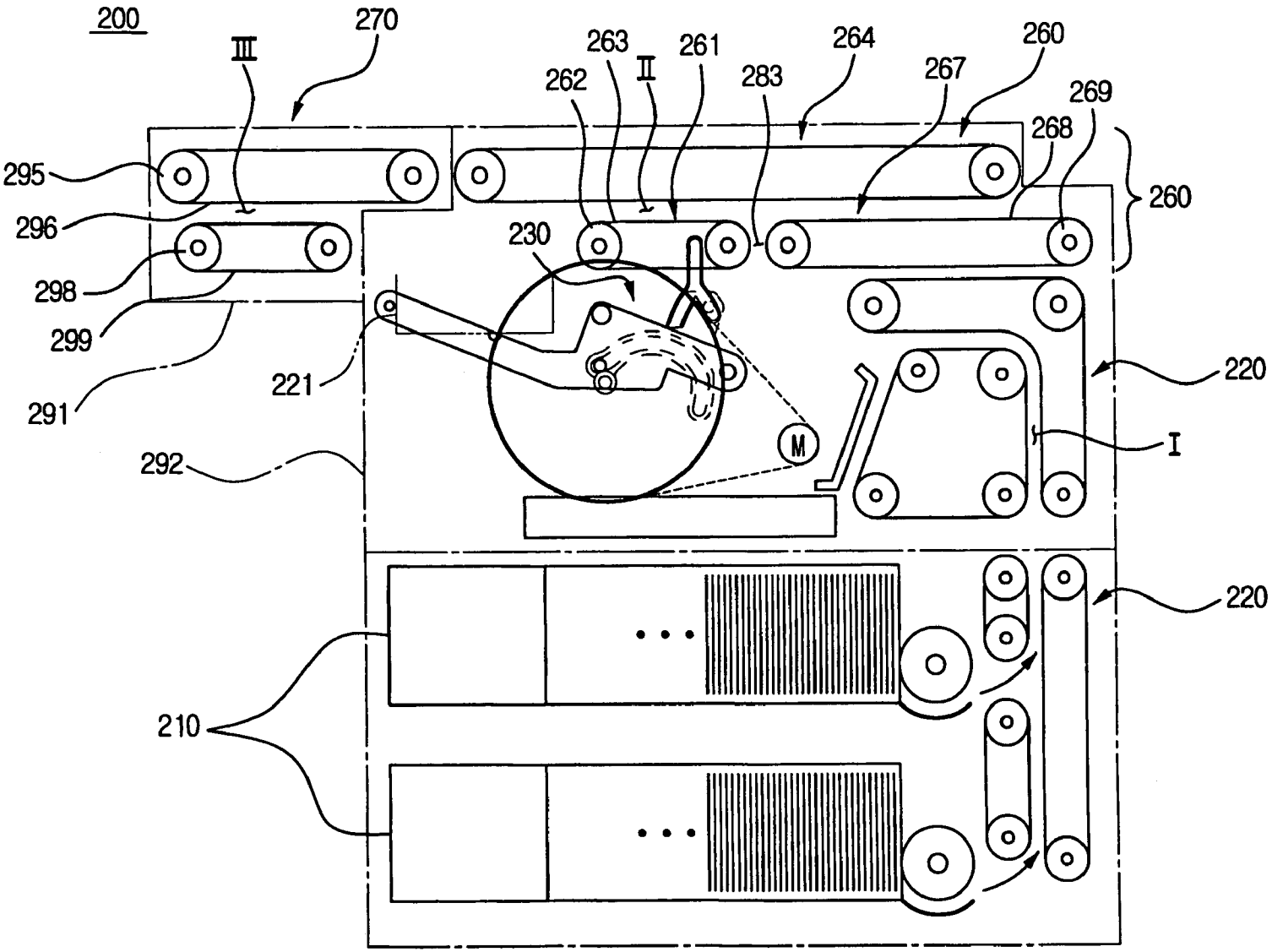
FIGS. 6 and 7 are configuration diagrams illustrating a withdrawal apparatus of a cash transaction machine, according to another embodiment of the present invention.
Figure 7:
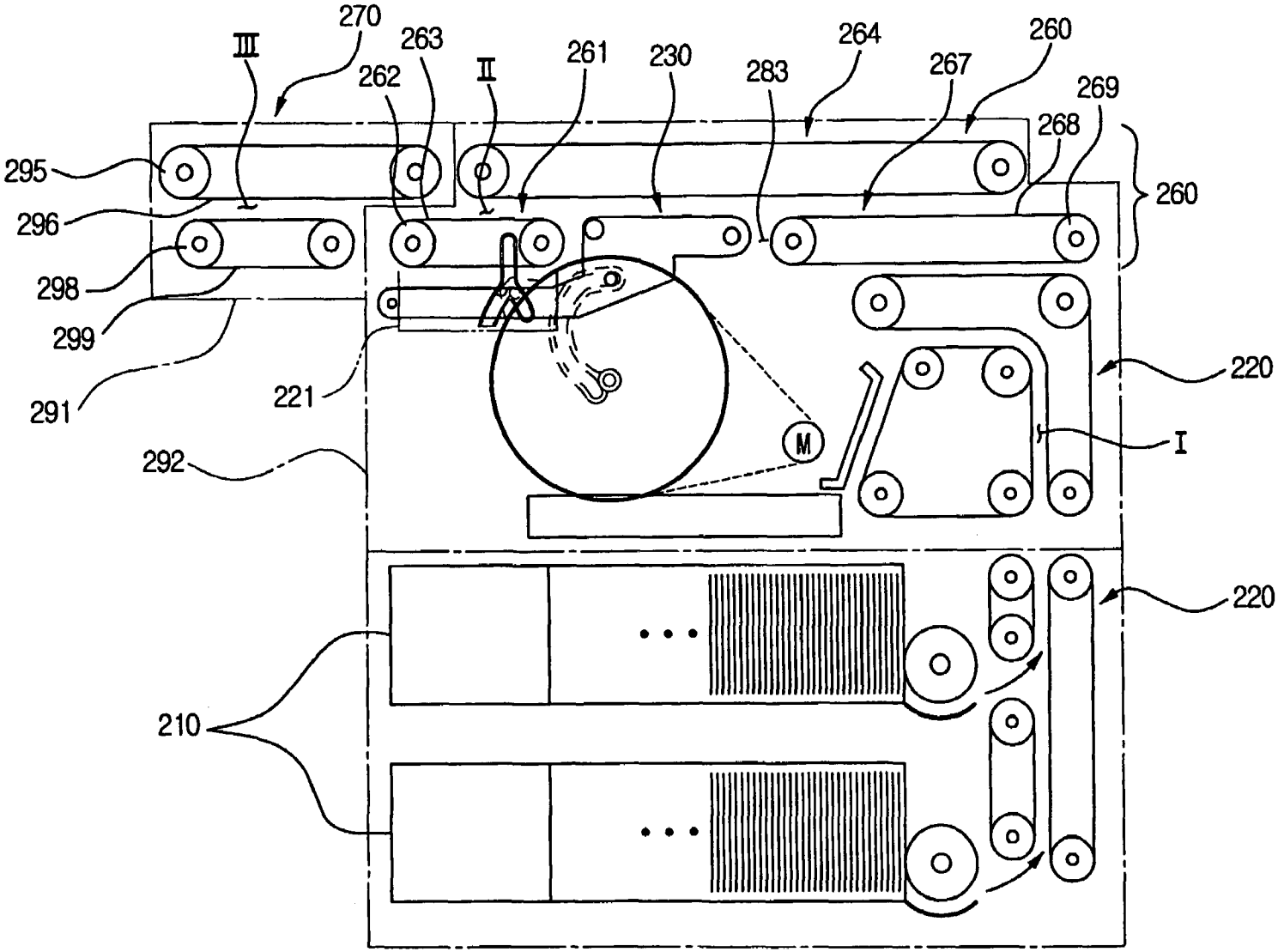

FIG. 6 is a configuration diagram illustrating a withdrawal apparatus of a cash transaction machine according to another embodiment of the present invention, and FIG. 7 is a configuration diagram illustrating operation mechanism of the withdrawal apparatus of FIG. 6.

Referring to FIG. 6, a withdrawal apparatus 200 according to the present invention includes a storage 210, a first transfer element 220, a temporary stack part 230, a second transfer element 260, and a withdrawal extension part 270. The withdrawal apparatus 200 includes two storages 210 for storing paper media and may select one of the two storages 210 to withdraw a requested amount of the paper media. The paper media withdrawn sheet by sheet from the storage 210 is transferred by the first transfer element 220 and is loaded in the temporary stack part 230 sheet by sheet. In case that a predetermined amount of the paper media is loaded, the temporary stack part 230 moves to the second transfer element 260 and a stack of the paper media is located on a transfer path II defined by the second transfer element 160 and may be transferred to the withdrawal extension part 270.

The paper media transferred from the storage 210 is stacked sheet by sheet in the temporary stack part 230. In case that a predetermined amount of the paper media is stacked, the first transfer element 220 may stop transferring the paper media and the temporary stack part 230 supporting the stack of the paper media is transferred to the transfer element 260.

Referring to FIG. 5, the top surface of the temporary stack part 230 is moved to be located on the transfer path II of the second transfer element 260 and may be a part of the transfer path II defined by the second transfer element 260.

After the temporary stack part 230 is transferred to the second transfer element 260, the second transfer element 260 starts to operate and transfers the paper media stack 232 in the temporary stack part 230 to the withdrawal extension part 270. The paper media is transferred in a stack in the second transfer element 260 and is kept being partially held by the second transfer element 260 in the withdrawal extension part 270. When the paper media stack 232 is discharged from the withdrawal extension part 270, a customer can receive a requested amount of money.

To more particularly describe a procedure in which the paper media stack 232 is transferred by the second transfer element 260 along the transfer path II, the second transfer element 260 includes an upper transfer part 264 and a lower transfer part 267. The upper transfer part 264 includes upper rollers 265 provided at both upper ends of the transfer path II and an upper rotation transfer belt 266 passing through the upper rollers 265 and rotating. The lower transfer part 267 includes lower rollers 268 provided at one side of an entry space 283 fro the temporary stack part 230 below the transfer path II and a lower rotation transfer belt 269 passing through the lower rollers 268 and rotating the path except the entry space 283. The withdrawal apparatus further includes a moving cover 261 provided at the other of the entry space 283 and horizontally slid, cover rollers 262 installed at both ends of the moving cover 261, a cover rotation transfer belt 263 passing through the cover rollers 262 and rotating, and a rejecting box 221 opened and closed by the move of the moving cover 261. The lower transfer part 267 and the moving cover 261 are longer than the upper transfer part 264 and projected from the both ends of the upper transfer part 264 as the same length to be symmetrical with each other.

Referring to FIGS. 6 and 7, the withdrawal apparatus 200 includes housing plates 292 facing each other, which are shown as a one-dot chain line in figures. The housing plates 292 are departed by a predetermined distance enough to receive the first transfer element 220, the temporary stack part 230 and the second transfer element 260. First unevenness portions are formed on the both upper end portions, corresponding to the end portion structure of the second transfer element 260, and the withdrawal extension part 270 is installed in extension plates facing each other, which are departed as the same width of the housing plates 292, as shown as a one-dot chain line. Second unevenness portions are formed in an end portion of extension plates 291, respectively. Accordingly, the withdrawal extension part 270 may be selectively installed the front end portion or the rear end portion of the withdrawal apparatus 200, because the second unevenness portion formed in the end portion of the extension plates 291 are engaged with the first unevenness portion of the housing plate 292.

Also, the withdrawal extension part 270 selectively installed at the front end portion and the rear end portion of the withdrawal apparatus 200 includes first extension rollers 295 provided at both ends above an extension path III and conveying the stack of the paper media transferred by the transfer path II, first extension rotation transfer belt 296 passing through the first extension rollers 295 and rotating, second extension rollers 298 provided at both ends below the extension path III, and a second extension rotation transfer belt 299 passing through the second extension rollers 298 and rotating.

Figure 8:
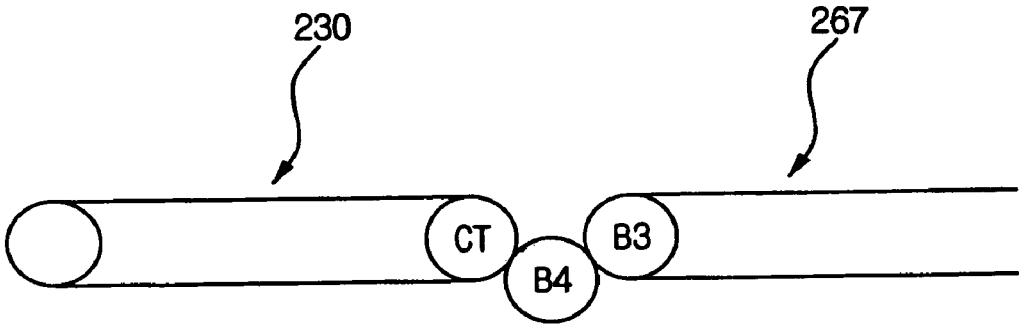
FIGS. 8 and 9 are schematic diagrams illustrating power conveyance of a cash transaction conveyance, according to another embodiment of the present invention.

FIG. 8 is a schematic diagram illustrating a procedure in which power is conveyed from a drive motor to an upper transfer part, a lower transfer part, and a withdrawal extension part. Referring to FIG. 8, since the structure of the present embodiment, in which the power is conveyed from the drive motor M to the upper transfer part 264, the lower transfer part 267, and the withdrawal extension part 270, is substantially identical with the structure of the first embodiment of the present invention, the description of the structure will be omitted. Only, the description with respect to power conveyance of the moving cover 261 and the temporary stack part 230 may be added.

In the procedure of conveying power from a third branch B3 to the moving cover 261, the third branch gear B3 receiving the rotation of the drive motor from a main drive belt is installed adjacent to the entry space and a fourth branch gear B4 is engaged with the third branch gear B3 and receive the rotation power.

In case that the moving cover is located at the entry space, a cover transmission gear installed at the pivot of the cover roller CT receives the rotation power from the fourth branch gear B4 and rotates in the opposite direction of the third branch gear.

Figure 9:
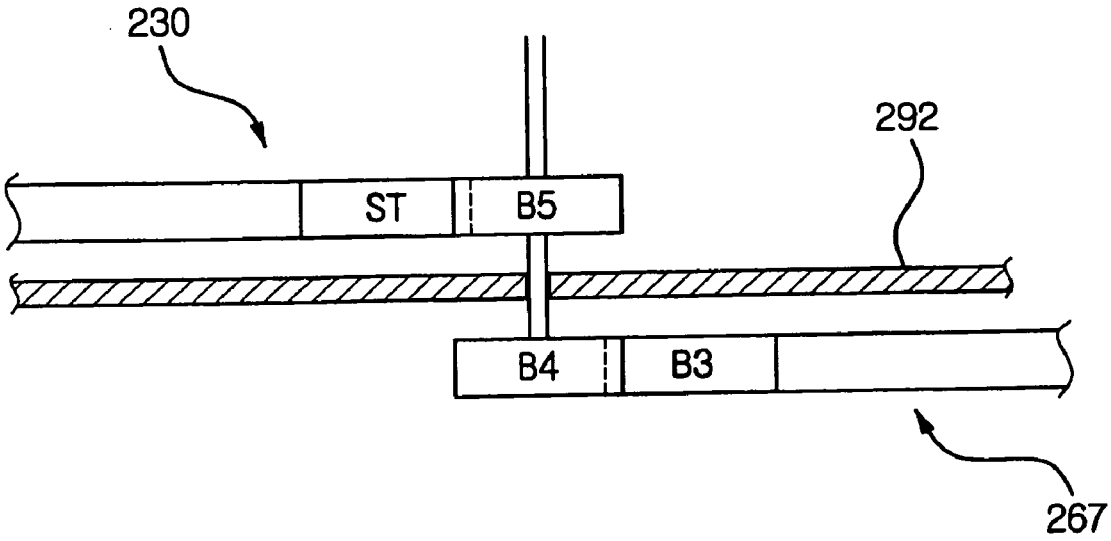

FIG. 9 is a schematic diagram illustrating the procedure in which power is conveyed from a drive motor to a temporary stack part. Referring to FIG. 9, the third branch gear B3 installed adjacent to the entry space receives rotation power from the drive motor M.

The fourth branch gear B4 engaged with the third branch gear B3 to receive the rotation power and the fifth branch gear B5 installed at the same pivot of the fourth branch gear B4 are installed in the housing plate 292.

In case that the temporary stack part 230 is located in the entry space, a stack transmission gear ST installed at the pivot of a stack roller SR of the temporary stack part 230 receives the rotation power from the fifth branch gear B5 and rotates in the opposite direction of the third branch gear B3.

In the withdrawal apparatus of the present invention, first and second transfer elements may be mutually separated and independently operate. Since the first transfer element transfers cash from a cash cassette to a temporary stack part sheet by sheet, the possibility of generating a jam is small. Also, the second transfer element transfers the cash transferred to a transfer path by the temporary stack part in a stack and may operate regardless of the first transfer element.

Accordingly, converting the withdrawal apparatus of the present invention may be easily performed, and the withdrawal apparatus can be installed in various machines by using one model.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A withdrawal apparatus of a cash transaction machine, comprising:

a storage for storing paper media;

a first transfer element transferring the paper media sheet by sheet from the storage;

a temporary stack part located at an end portion of the first transfer element to stack the transferred paper media and vertically transfer a stack of the paper media;

a second transfer element located above the temporary stack part, including an upper transfer part defining the upper boundary of a transfer path for transferring the stack of the paper media and a lower transfer part defining the lower boundary of the transfer path together with the temporary stack part, two end portions of the second transfer element being symmetrical; and a withdrawal extension part formed corresponding to the one end portion of the second transfer element and installed on the side of the second transfer element to provide an extension path connected to the transfer path, wherein:

the upper transfer part includes upper rollers provided at the both ends above the transfer path and an upper rotation transfer belt passing through the upper rollers;

the lower transfer part includes lower rollers provided below the transfer path except an entry space for the temporary stack part in the transfer oath and at least one lower rotation transfer belt passing through the lower rollers and rotating the oath except the entry space; and the lower transfer part is longer than the upper transfer part to be projected from the both ends of the upper transfer part as the same length.

2. The apparatus of claim 1, wherein:

the lower transfer part includes lower rollers provided at one side of the entry space, the withdrawal apparatus further comprises a moving cover provided at the other side of the entry space for sliding along the transfer path, a cover rollers installed at the both ends of the moving cover, a cover rotation transfer belt passing through the cover rollers, and a rejecting element including a rejecting box opened and closed by the movement of the moving cover, and the lower transfer part and the moving cover are longer than the upper transfer part to be projected from the transfer path as the same length.

3. The apparatus of claim 2, wherein the first transfer element, the temporary stack part, and the second transfer element are installed between housing plates facing each other, first unevenness portions are formed at the both top end of the housing plates, the withdrawal extension part is installed between extension plates departed parallel by the same interval of the housing plates, and second unevenness portions are formed at an end portion of the extension plates, corresponding to the first unevenness portions.

4. The apparatus of claim 3, wherein the withdrawal extension part includes first extension rollers provided at both ends above the extension path, a first extension rotation transfer belt passing through the first extension rollers, second extension rollers provided at both ends below the extension path, and a second extension rotation transfer belt passing through the second extension rollers.

5. The apparatus of claim 4, further comprising:

a drive motor;

a first branch gear installed adjacent to one of the upper rollers, for receiving rotation power from the drive motor;

a first transmission gear installed at the pivot of the upper roller, for transmitting rotation power from the first branch gear to the upper roller;

a second transmission gear installed at the pivot of the first extension roller and engaged with the first branch gear for transmitting rotation power from the first branch gear to the first extension roller a third transmission gear installed at the pivot of the second extension roller for transmitting rotation power from the second transmission gear to the second extension roller, the third transmission gear rotating in the opposite direction of the second transmission gear; and a main drive belt transmitting the rotation power of the drive motor to the first branch gear.

6. The apparatus of claim 5, further comprising a second branch gear engaged with the third transmission gear, wherein the second branch gear is connected to the second transmission gear by a belt to rotate in the same direction.

7. The apparatus of claim 4, further comprising:

a drive motor;

a third branch gear installed adjacent to one of the lower rollers for receiving the rotation power from the drive motor;

a fourth branch gear engaged with the third branch gear for receiving the rotation power from the third branch gear;

a fourth transmission gear installed at the pivot of the lower roller for receiving the rotation power from the fourth branch gear to rotate in the opposite direction of the third branch gear; and a main drive belt transmitting the rotation of the drive motor to the third branch belt.

8. A withdrawal apparatus of a cash transaction machine, comprising:

a storage for storing paper media;

a first transfer element transferring the paper media sheet by sheet from the storage;

a temporary stack part including a stack supporter located at an end portion of the first transfer element to stack the transferred paper media and transfer a stack of the paper media substantially vertically, stack rollers installed at both ends of the stack supporter, and a stack rotation transfer belt passing through the stack rollers;

a second transfer element including an upper transfer part located above the temporary stack part to define the upper boundary of a transfer path for transferring the stack of the paper media and a lower transfer part defining the lower boundary of the transfer path together with the temporary stack part at one side of an entry space for the temporary stack pan in the transfer path;

a rejecting element including a moving cover provided at the other side of the entry space to slide along the transfer path and define the lower boundary with the lower transfer part, and a rejecting box opened and closed by the movement of the moving cover, the rejecting element and the second transfer element having symmetrical end structures; and a withdrawal extension part formed corresponding to the end structure of the second transfer element and the rejecting element and installed in the end structure to provide an extension path connected to the transfer path, wherein, in the second transfer element, the upper transfer part includes upper rollers provided at both ends of the transfer path and upper rotation transfer belt passing through the upper rollers;

the lower transfer part includes lower roller provided at one side of the entry space for the temporary stack part in the transfer path below the transfer path and a lower rotation transfer belt passing though the lower rollers and rotating a path except the entry space; and the lower transfer part and the moving cover are longer than the upper transfer part and projected from both ends of the transfer part as the same length.

9. The apparatus of claim 8, further comprising:

a drive motor;

a first branch gear installed adjacent to one of the upper rollers for receiving rotation power from the drive motor;

a first transmission gear installed at the pivot of the upper roller for transmitting rotation power from the first branch gear to the upper roller;

a second transmission gear installed at the pivot of the first extension roller and engaged with the first branch gear for transmitting rotation power from the first branch gear to the first extension roller;

a third transmission gear installed at the pivot of the second extension roller for transmitting rotation power from the second transmission gear to the second extension roller, the third transmission gear rotating in the opposite direction of the second transmission gear; and a main drive belt transmitting the rotation power of the drive motor to the first branch gear.

10. The apparatus of claim 9, further comprising a second branch gear engaged with the third transmission gear, in which the second branch gear is connected to the second transmission gear by a belt to rotate in the same direction.

11. The apparatus of claim 8, wherein the rejecting element further comprises cover rollers installed at both ends of the moving cover and a cover rotation transfer belt passing through the cover rollers.

12. The apparatus of claim 11, further comprising:

a drive motor;

a third branch gear installed adjacent to the entry space for receiving rotation power from the drive motor;

a fourth branch gear engaged with the third branch gear for receiving the rotation power from the third branch gear;

a cover transmission gear installed at the pivot of the cover roller for receiving the rotation power from the fourth branch gear, so to rotate in the opposite direction of the third branch gear, in case that the moving cover is located in the entry space; and a main drive transmitting the rotation of the drive motor to the third branch gear.

13. The apparatus of claim 8, wherein the first transfer element, the temporary stack part, and the second transfer element are installed between housing plates facing each other, the withdrawal apparatus further comprising:

a drive motor;

a third branch gear installed adjacent to the entry space and receiving rotation power from the drive motor;

a fourth branch gear engaged with the third branch gear for receiving the rotation power from the third branch gear;

a fifth branch gear installed at the pivot identical with the fourth branch gear and located inside the housing plates;

a stack transmission gear installed at the pivot of the stack roller and receiving the rotation power from the fifth branch gear to rotate in the opposite direction of the third branch gear in case that the temporary stack part is located in the entry space; and a main drive belt transmitting the rotation of the drive motor to the third branch motor.

* * * * *